US011779177B2

(12) United States Patent
Kronenberger

(10) Patent No.: US 11,779,177 B2
(45) Date of Patent: Oct. 10, 2023

(54) FAN BLADE CLEANING ASSEMBLY

(71) Applicant: Scott Kronenberger, Belleville, IL (US)

(72) Inventor: Scott Kronenberger, Belleville, IL (US)

( * ) Notice: Subject to any disclaimer, the term of this patent is extended or adjusted under 35 U.S.C. 154(b) by 336 days.

(21) Appl. No.: 17/124,571

(22) Filed: Dec. 17, 2020

(65) Prior Publication Data

US 2022/0192448 A1 Jun. 23, 2022

(51) Int. Cl.

| | |
|---|---|
| ***A47L 9/06*** | (2006.01) |
| ***F04D 29/70*** | (2006.01) |
| ***A47L 7/00*** | (2006.01) |

(52) U.S. Cl.

CPC ..... *A47L 9/0693* (2013.01); *A47L 7/009* (2013.01); *A47L 9/0613* (2013.01); *F04D 29/703* (2013.01)

(58) Field of Classification Search

CPC ..... A47L 9/0693; F28G 1/166
USPC ..... 15/394
See application file for complete search history.

(56) References Cited

U.S. PATENT DOCUMENTS 4,823,431 A * 4/1989 Carpenter ..... A47L 9/06 15/235
4,832,572 A 5/1989 Prucha
4,841,592 A * 6/1989 Restivo ..... A47L 25/00 15/210.1
5,235,722 A * 8/1993 Harris ..... A47L 9/0693 15/394
D341,452 S * 11/1993 Songer ..... D4/130
5,313,687 A * 5/1994 Schneider ..... A47L 9/06 15/394
5,359,751 A * 11/1994 Bellardini ..... A47L 4/00 15/210.1
5,369,836 A * 12/1994 Horne ..... A47L 4/00 15/210.1
5,765,259 A * 6/1998 Cika ..... A47L 4/00 15/396
6,345,409 B1 * 2/2002 LaCroix ..... A47L 9/0693 134/21
7,363,674 B2 * 4/2008 Marshall ..... A47L 4/00 15/210.1
11,363,924 B1 * 6/2022 Campo ..... A47L 9/0693
2012/0167919 A1 * 7/2012 Kunes ..... A47L 9/0693 134/6
2021/0353120 A1 * 11/2021 Castellanos ..... A47L 9/0686

* cited by examiner

*Primary Examiner* — Bryan R Muller

(57) ABSTRACT

A fan blade cleaning assembly for cleaning a ceiling fan blade includes a sleeve that is elongated for sliding onto a ceiling fan blade. A plurality of brushes is each coupled to the sleeve and each of the brushes is positioned within the sleeve. In this way each of the brushes can clean the ceiling fan blade when the sleeve is slid thereon. Moreover, the plurality of brushes is strategically positioned to clean a top surface and a bottom surface of the ceiling fan blade. A hose is fluidly coupled to the sleeve and the hose can be fluidly coupled to a vacuum source to facilitate the vacuum source to remove the dust and debris from the sleeve.

6 Claims, 6 Drawing Sheets

FAN BLADE CLEANING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR Not Applicable

BACKGROUND OF THE INVENTION

(1) Field of the Invention

The disclosure relates to cleaning devices and more particularly pertains to a new cleaning device for cleaning a ceiling fan blade. The cleaning device includes a vacuum source for capturing dust and debris that is cleaned from the ceiling fan blade. In this way the dust and debris is inhibited from falling onto the floor when the ceiling fan blade is cleaned.

(2) Description of Related Art including information disclosed under 37 CFR 1.97 and 1.98.

The prior art relates to cleaning devices including a sleeve that is removably positionable over a ceiling fan blade for capturing dust and subsequently being laundered. The prior art discloses a vacuum nozzle that has a longitudinally elongated profile. The prior art discloses a tube that is slidable around a ceiling fan blade and which includes scrubbing element for scrubbing dust and debris from the ceiling fan blade. The prior art discloses a scrubber that has a channel extending therethrough for insertably receiving a ceiling fan blade and which is fluidly coupled to a vacuum for capturing the dust and debris. In no instance does the prior art disclose a sleeve that encloses a ceiling fan blade, bristles for cleaning the ceiling fan blade and a vacuum source for capturing dust and debris.

BRIEF SUMMARY OF THE INVENTION

An embodiment of the disclosure meets the needs presented above by generally comprising a sleeve that is elongated for sliding onto a ceiling fan blade. A plurality of brushes is each coupled to the sleeve and each of the brushes is positioned within the sleeve. In this way each of the brushes can clean the ceiling fan blade when the sleeve is slid thereon. Moreover, the plurality of brushes is strategically positioned to clean a top surface and a bottom surface of the ceiling fan blade. A hose is fluidly coupled to the sleeve and the hose can be fluidly coupled to a vacuum source to facilitate the vacuum source to remove the dust and debris from the sleeve.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
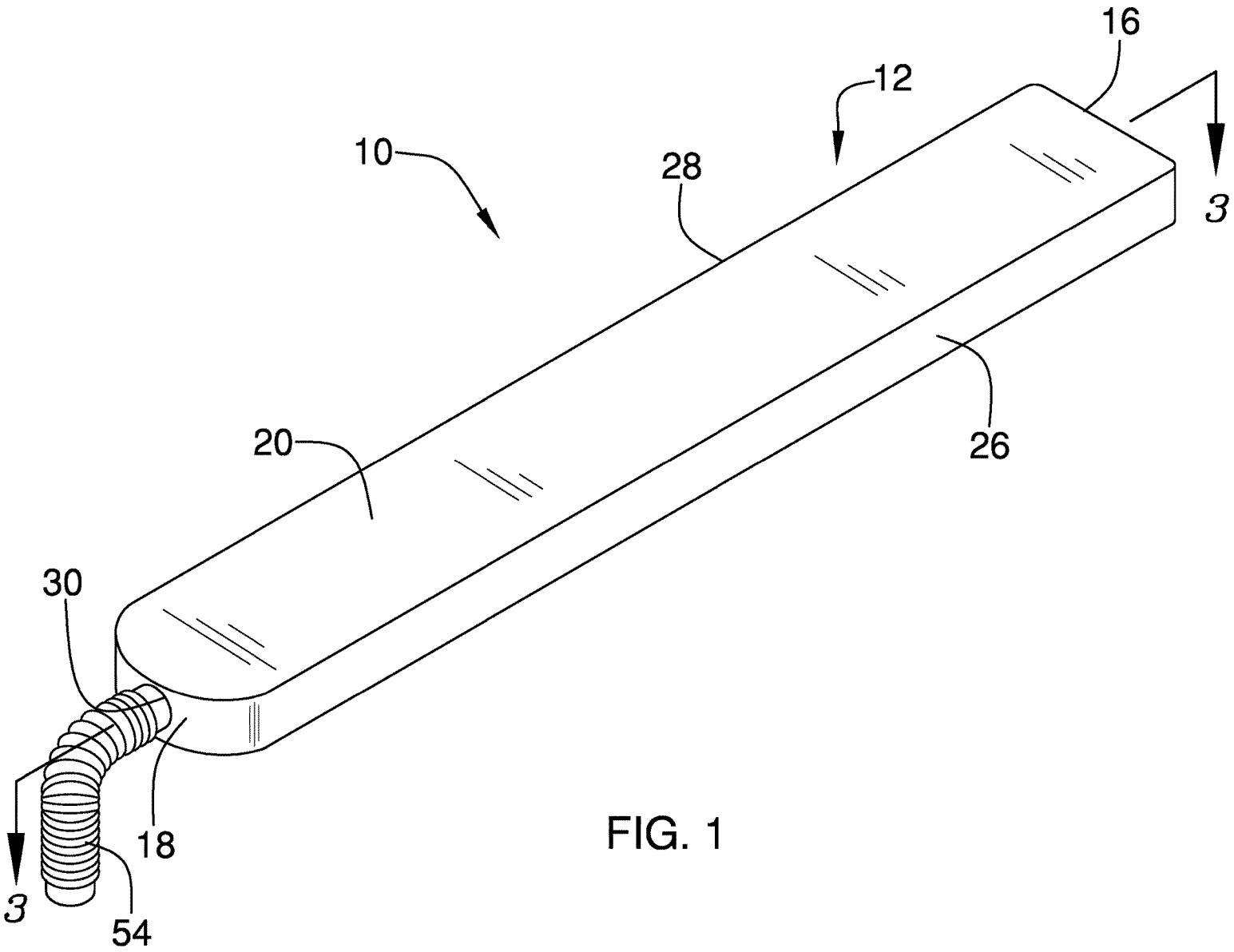
FIG. 1 is a top perspective view of a fan blade cleaning assembly according to an embodiment of the disclosure.
Figure 2:
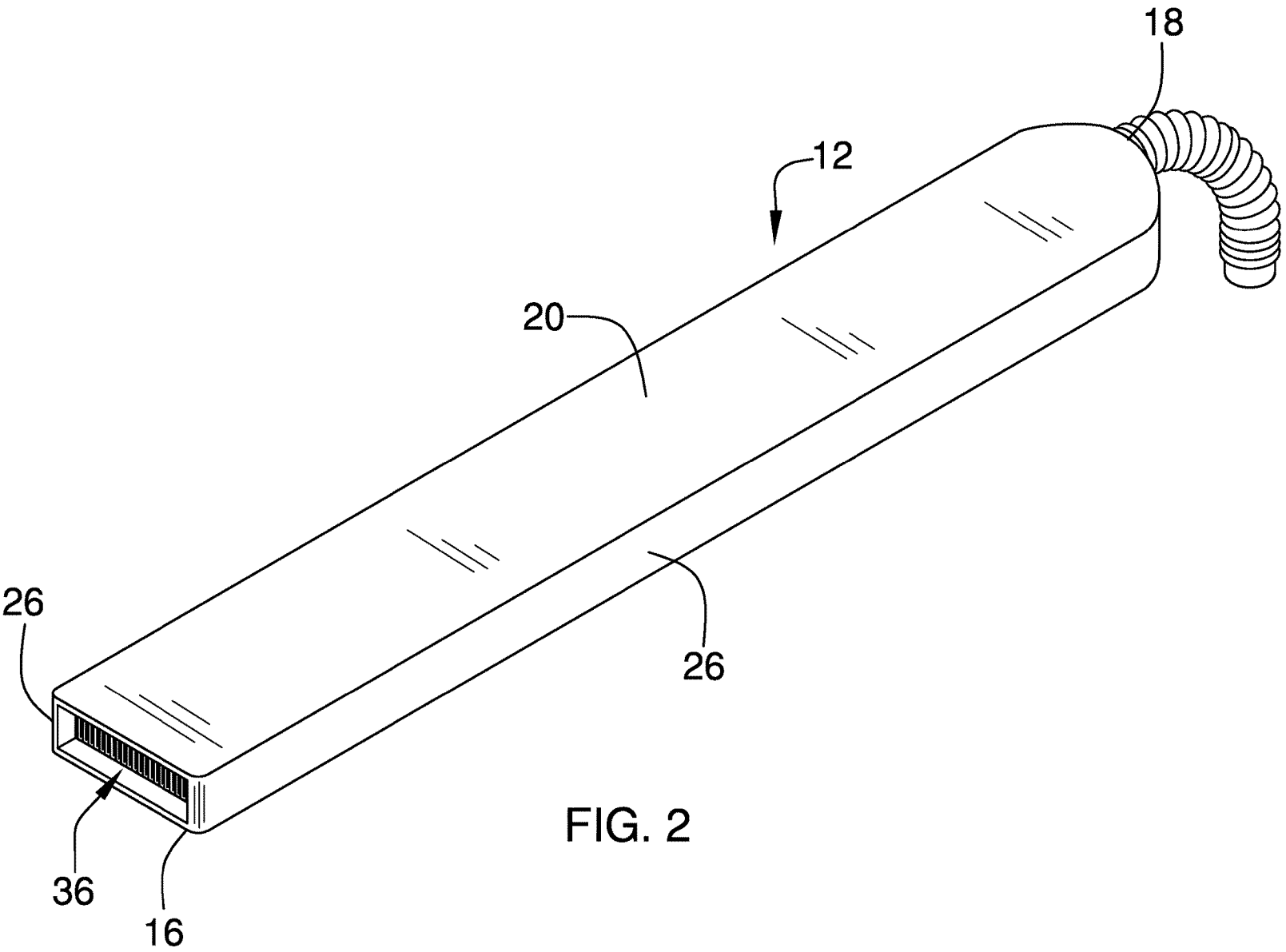
FIG. 2 is a front perspective view of an embodiment of the disclosure.
Figure 3:
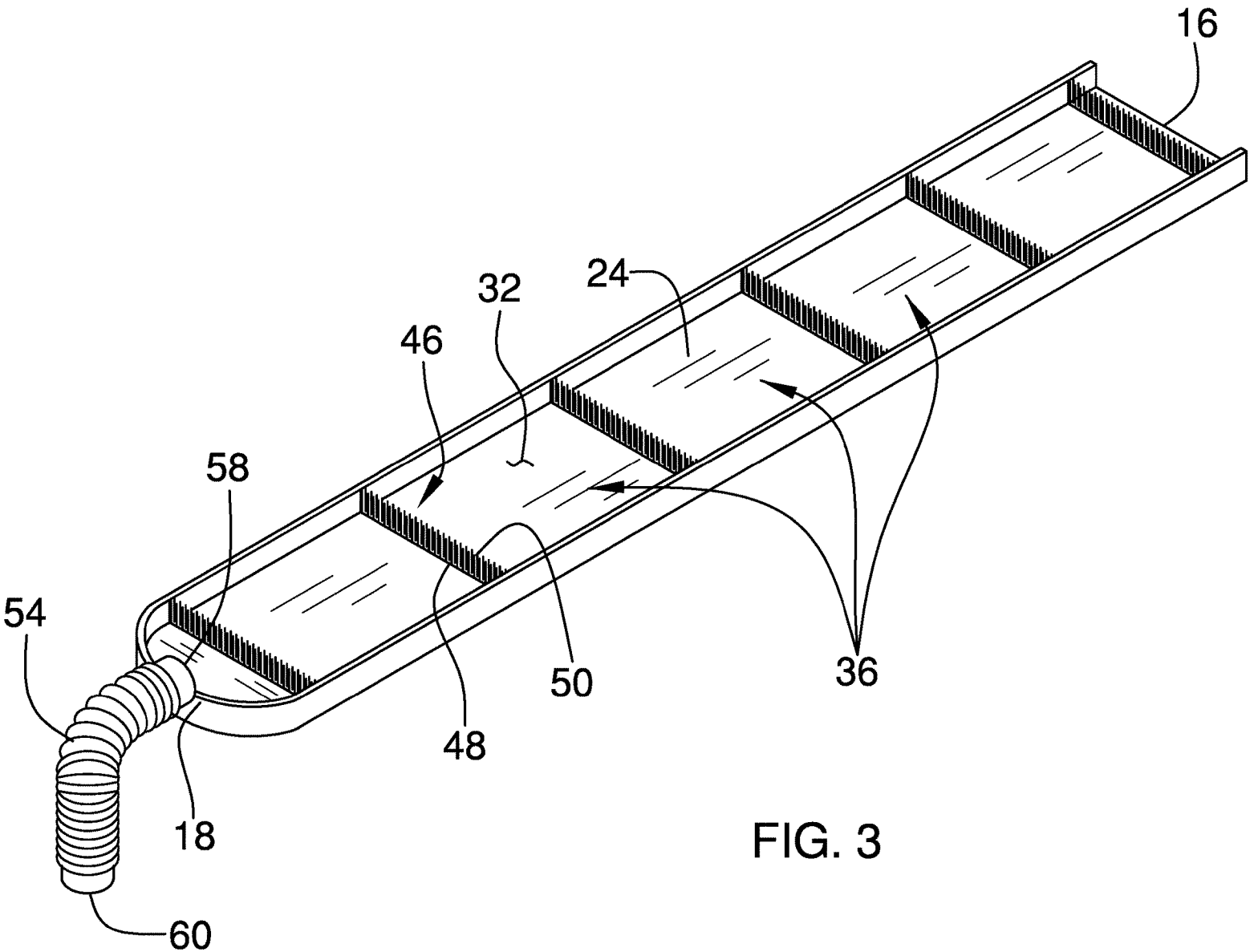
FIG. 3 is a cross sectional view taken along line 3-3 of FIG. 1 of an embodiment of the disclosure.
Figure 4:
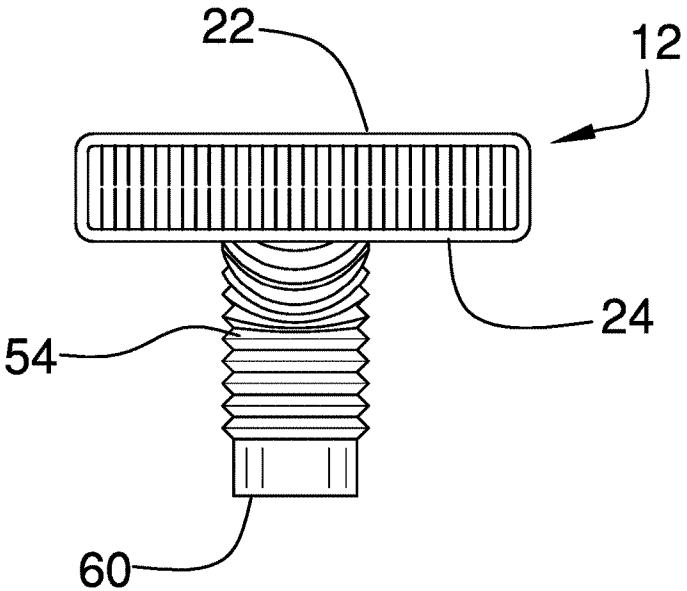
FIG. 4 is a front view of an embodiment of the disclosure.
Figure 5:
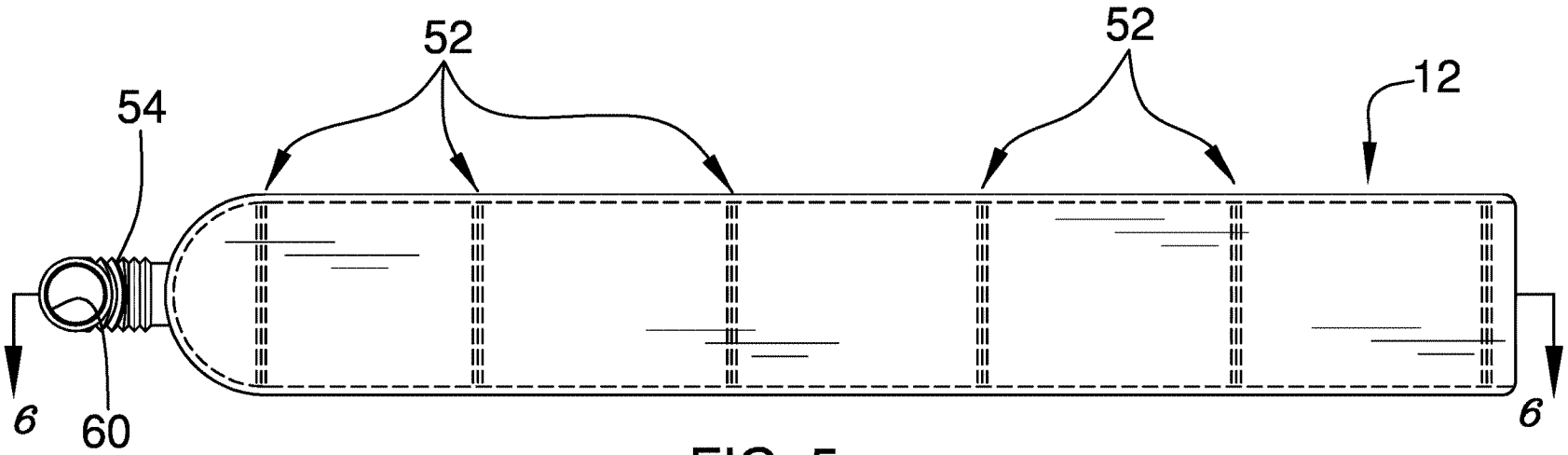
FIG. 5 is a bottom phantom view of an embodiment of the disclosure.
Figure 6:
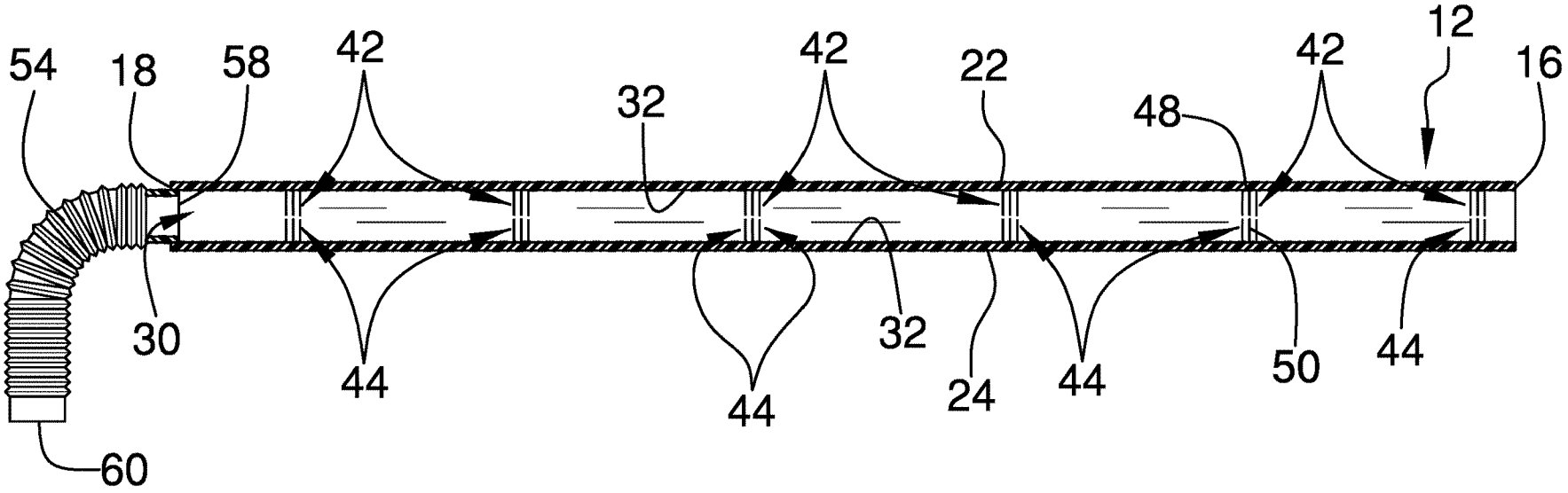
FIG. 6 is a cross sectional view taken along line 6-6 of FIG. 5 of an embodiment of the disclosure.
Figure 7:
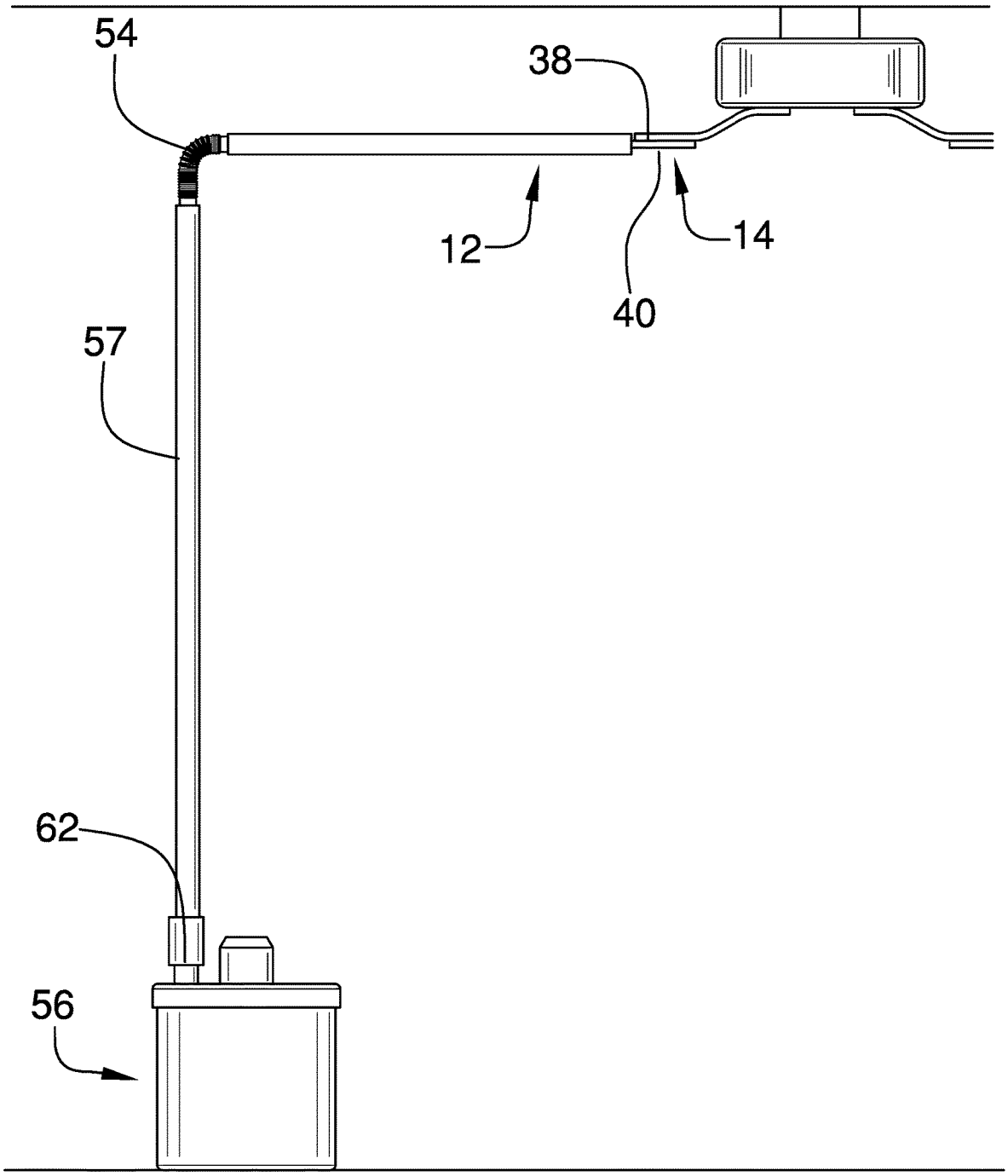
FIG. 7 is a perspective in-use view of an embodiment of the disclosure.

With reference now to the drawings, and in particular to FIGS. 1 through 7 thereof, a new cleaning device embodying the principles and concepts of an embodiment of the disclosure and generally designated by the reference numeral 10 will be described.

As best illustrated in FIGS. 1 through 7, the fan blade cleaning assembly 10 generally comprises a sleeve 12 that is elongated such that the sleeve 12 can be slid completely onto a ceiling fan blade 14. The ceiling fan blade 14 may be a blade on a ceiling fan of any conventional design, including but not being limited to, electric ceiling fans and belt driven ceiling fans. The sleeve 12 has a first end 16, a second end 18 and an outer wall 20 extending therebetween, and the outer wall 20 has a top side 22, a bottom side 24, a first lateral side 26 and a second lateral side 28. The sleeve 12 is elongated between the first end 16 and the second end 18, and the first end 16 is open to insertably receive the ceiling fan blade 14. Additionally, the sleeve 12 may be manufactured in a variety of lengths and widths for accommodating blade designs of a variety of ceiling fan manufacturers.

The second end 18 has an air aperture 30 extending therethrough for passing air therethrough. Each of the top side 22 and the bottom side 24 has an inwardly facing surface 32. Additionally, each of the top side 22 and the bottom side 24 has a width that is greater than a height of each of the first lateral side 26 and the second lateral side 28. In this way the sleeve 12 defines a rectangular cuboid thereby facilitating the sleeve 12 to contain dust and debris 34 from the ceiling fan blade 14.

A plurality of brushes 36 is provided and each of the brushes 36 is coupled to the sleeve 12. Each of the brushes 36 is positioned within the sleeve 12 such that each of the brushes 36 can clean the ceiling fan blade 14 when the sleeve 12 is slid thereon. The plurality of brushes 36 is strategically positioned within the sleeve 12 to clean a top surface 38 and a bottom surface 40 of the ceiling fan blade 14. Moreover, the plurality of brushes 36 includes a set of first brushes 42 and a second of second brushes 44. Each of the set of first brushes 42 and each of the set of second brushes 44 comprises a plurality of bristles 46 that each has a coupled end 48 and a free end 50.

The coupled end 48 of each of the bristles 46 that are associated with the first brushes 42 is coupled to the inwardly facing surface 32 of the top side 22 of the outer wall 20 of the sleeve 12. Additionally, each of the set of first brushes 42 is organized into a row 52 extending between the first lateral side 26 and the second lateral side 28. The rows 52 defined by each of sets of first brushes 42 are spaced apart from each other and are distributed between the first end 16 and the second end 18. The coupled end 48 of each of the bristles 46 that are associated with the second brushes 44 is coupled to the inwardly facing surface 32 of the bottom side 24 of the outer wall 20 of the sleeve 12. Each of the set of second brushes 44 is organized into a row 52 extending between the first lateral side 26 and the second lateral side 28. Moreover, the rows 52 defined by each of sets of second brushes 44 are spaced apart from each other and are distributed between the first end 16 and the second end 18. Each of the rows 52 defined by the set of second brushes 44 is aligned with a respective one of the rows 52 defined by the set of first brushes 42.

A hose 54 is fluidly coupled to the sleeve 12 and the hose 54 can be fluidly coupled to a vacuum source 56. The vacuum source 56 may be an electric vacuum such as a shop vac or other similar device. The hose 54 is in fluid communication with an interior of the sleeve 12 to facilitate the vacuum source 56 to remove the dust and debris 34 from the sleeve 12. In this way the dust and debris 34 is inhibited from falling onto the floor when the ceiling fan blade 14 is being cleaned. The hose 54 has a primary end 58 and a secondary end 60, and the primary end 58 is coupled to the second end 18 of the sleeve 12. The secondary end 60 can be fluidly coupled to a suction port 62 of the vacuum source 56 or a suction pipe 57 of the vacuum source 56. Additionally, the primary end 58 is aligned with the air aperture 30 to direct the dust and debris 34 into the vacuum source 56. The hose 54 may comprise a flexible plastic hose that with a similar diameter and construction to existing vacuum hoses.

In use, the hose 54 is connected to the suction port 62 of the vacuum source 56 and the first end 16 of the sleeve 12 is slid onto the ceiling fan blade 14. In this way the brushes 36 in the sleeve 12 can brush the top surface 38 and the bottom surface 40 of the ceiling fan blade 14 as the ceiling fan blade 14 is fully inserted into the sleeve 12. Additionally, the sleeve 12 captures the dust and debris 34 that is brushed from the ceiling fan blade 14 thereby facilitating the vacuum source 56 to suctionally remove the dust and debris 34. In this way the ceiling fan blade 14 can be cleaned without dropping any of the dust and debris 34 onto the floor.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A fan blade cleaning assembly for cleaning ceiling fan blades while capturing dust cleaned from the ceiling fan blade, said assembly comprising:

a sleeve being elongated in shape wherein said sleeve is configured to be slid onto a ceiling fan blade, wherein said sleeve has a first end, a second end and an outer wall extending therebetween, said outer wall having a top side, a bottom side, a first lateral side and a second lateral side, said sleeve being elongated in shape between said first end and said second end, said first end being open wherein said first end is configured to insertably receive the ceiling fan blade, said second end having an air aperture extending therethrough wherein said air aperture is configured to pass air therethrough, said second end being rounded wherein said sleeve is configured for receiving the ceiling fan blade such that a distal end of the ceiling fan blade is positioned within the sleeve adjacent to the air aperture when the ceiling fan blade is fully inserted into said sleeve, each of said top side and said bottom side having an inwardly facing surface;

a plurality of brushes, each of said brushes being coupled to said sleeve, each of said brushes being positioned within said sleeve wherein each of said brushes is configured to clean the ceiling fan blade when said sleeve is slid thereon, said plurality of brushes being positioned within said sleeve wherein said plurality of brushes is configured to clean a top surface and a bottom surface of the ceiling fan blade; and a hose being fluidly coupled to said sleeve wherein said hose is configured to be fluidly coupled to a vacuum source, said hose being in fluid communication with an interior of said sleeve wherein said hose is configured to facilitate the vacuum source to remove the dust and debris from said sleeve, wherein said hose has a primary end and a secondary end, said primary end being directly attached to said second end of said sleeve wherein said secondary end is configured to be fluidly coupled to the vacuum source, said primary end being aligned with said air aperture wherein said hose is configured to direct the dust and debris into the vacuum source.

2. The assembly according to claim 1, wherein each of said top side and said bottom side has a width being greater than a height of each of said first lateral side and said second lateral side such that said sleeve defines a rectangular cuboid wherein said sleeve is configured to contain dust and debris from the ceiling fan blade.

3. The assembly according to claim 1, wherein:

said plurality of brushes includes a set of first brushes and a set of second brushes, each first brush of said set of first brushes and each second brush of said set of second brushes comprising a plurality of bristles, each of said bristles having a coupled end and a free end; and said coupled end of each of said bristles being associated with said first brushes is coupled to said inwardly facing surface of said top side of said outer wall of said sleeve, said set of first brushes being organized into rows extending between said first lateral side and said second lateral side, said rows defined by said set of first brushes being spaced apart from each other and being distributed between said first end and said second end.

4. The assembly according to claim 3, wherein said coupled end of each of said bristles being associated with said second brushes being coupled to said inwardly facing surface of said bottom side of said outer wall of said sleeve, said set of second brushes being organized into rows extending between said first lateral side and said second lateral side, said rows defined by said set of second brushes being spaced apart from each other and being distributed between said first end and said second end, each of said rows defined by said set of second brushes being aligned with a respective one of said rows defined by said set of first brushes.

5. The assembly of claim 1, further comprising:

each of said top side and said bottom side having an inwardly facing surface, each of said top side and said bottom side having a width being greater than a height of each of said first lateral side and said second lateral side such that said sleeve defines a rectangular cuboid wherein said sleeve is configured to contain dust and debris from the ceiling fan blade; and said plurality of brushes including a set of first brushes and a set of second brushes, each first brush of said set of first brushes and each second brush of said set of second brushes comprising a plurality of bristles, each of said bristles having a coupled end and a free end, said coupled end of each of said bristles being associated with said set of first brushes being coupled to said inwardly facing surface of said top side of said outer wall of said sleeve, said set of first brushes being organized into rows extending between said first lateral side and said second lateral side, said rows defined by said set of first brushes being spaced apart from each other and being distributed between said first end and said second end, said coupled end of each of said bristles being associated with said set of second brushes being coupled to said inwardly facing surface of said bottom side of said outer wall of said sleeve, said set of second brushes being organized into rows extending between said first lateral side and said second lateral side, said rows defined by set of second brushes being spaced apart from each other and being distributed between said first end and said second end, each of said rows defined by said set of second brushes being aligned with a respective one of said rows defined by said set of first brushes.

6. A fan blade cleaning system for cleaning ceiling fan blades while capturing dust cleaned from the ceiling fan blade, said system comprising:

a vacuum source having a suction port wherein said suction port is configured to draw air inwardly therein when said vacuum source is turned on;

a sleeve being elongated in shape wherein said sleeve is configured to be slid onto a ceiling fan blade, said sleeve having a first end, a second end and an outer wall extending therebetween, said outer wall having a top side, a bottom side, a first lateral side and a second lateral side, said sleeve being elongated in shape between said first end and said second end, said first end being open wherein said first end is configured to insertably receive the ceiling fan blade, said second end having an air aperture extending therethrough wherein said air aperture is configured to pass air therethrough, said second end being rounded wherein said sleeve is configured for receiving the ceiling fan blade such that a distal end of the ceiling fan blade is positioned within the sleeve adjacent to the air aperture when the ceiling fan blade is fully inserted into said sleeve, each of said top side and said bottom side having an inwardly facing surface, each of said top side and said bottom side having a width being greater than a height of each of said first lateral side and said second lateral side such that said sleeve defines a rectangular cuboid wherein said sleeve is configured to contain dust and debris from the ceiling fan blade, a plurality of brushes, each of said brushes being coupled to said sleeve, each of said brushes being positioned within said sleeve wherein each of said brushes is configured to clean the ceiling fan blade when said sleeve is slid thereon, said plurality of brushes being positioned within said sleeve wherein said plurality of brushes is configured to clean a top surface and a bottom surface of the ceiling fan blade, said plurality of brushes including a set of first brushes and a set of second brushes, each first brush of said set of first brushes and each second brush of said set of second brushes comprising a plurality of bristles, each of said bristles having a coupled end and a free end, said coupled end of each of said bristles being associated with said set of first brushes being coupled to said inwardly facing surface of said top side of said outer wall of said sleeve, said set of first brushes being organized into rows extending between said first lateral side and said second lateral side, said rows defined by said set of first brushes being spaced apart from each other and being distributed between said first end and said second end, said coupled end of each of said bristles being associated with said set of second brushes being coupled to said inwardly facing surface of said bottom side of said outer wall of said sleeve, said set of second brushes being organized into rows extending between said first lateral side and said second lateral side, said rows defined by said set of second brushes being spaced apart from each other and being distributed between said first end and said second end, each of said rows defined by said set of second brushes being aligned with a respective one of said rows defined by said set of first brushes; and a hose being fluidly coupled to said sleeve, said hose being fluidly attachable to said suction port of said vacuum source, said hose being in fluid communication with an interior of said sleeve wherein said vacuum source is configured to remove the dust and debris from said sleeve, said hose having a primary end and a secondary end, said primary end being directly attached to said second end of said sleeve, said secondary end being fluidly attachable to said suction port on said vacuum source, said primary end being aligned with said air aperture wherein said hose is configured to direct the dust and debris into said vacuum source.

* * * * *